US010729200B2

(12) United States Patent
Sicking et al.

(10) Patent No.: US 10,729,200 B2
(45) Date of Patent: Aug. 4, 2020

(54) PROTECTIVE HELMETS HAVING ENERGY ABSORBING TETHERS

(71) Applicant: THE UAB RESEARCH FOUNDATION, Birmingham, AL (US)

(72) Inventors: Dean Sicking, Birmingham, AL (US); Blake Feltman, Birmingham, AL (US); James T. Houston, Birmingham, AL (US)

(73) Assignee: THE UAB RESEARCH FOUNDATION, Birmingham, AL (US)

( * ) Notice: Subject to any disclaimer, the term of this patent is extended or adjusted under 35 U.S.C. 154(b) by 338 days.

(21) Appl. No.: 15/523,482

(22) PCT Filed: Nov. 11, 2015

(86) PCT No.: PCT/US2015/060227
§ 371 (c)(1),
(2) Date: May 1, 2017

(87) PCT Pub. No.: WO2016/077503
PCT Pub. Date: May 19, 2016

(65) Prior Publication Data

US 2017/0303620 A1 Oct. 26, 2017

Related U.S. Application Data

(60) Provisional application No. 62/078,007, filed on Nov. 11, 2014.

(51) Int. Cl.
*A42B 3/04* (2006.01)
*A42B 3/06* (2006.01)
(Continued)

(52) U.S. Cl.
CPC ..... *A42B 3/0473* (2013.01); *A42B 3/046* (2013.01); *A42B 3/063* (2013.01); *A42B 3/064* (2013.01);
(Continued)

(58) Field of Classification Search
CPC ..... A42B 3/0473; A42B 3/046; A42B 3/063; A42B 3/064; A42B 3/127; A42B 3/20; A63B 71/10; A63B 71/12
See application file for complete search history.

(56) References Cited

U.S. PATENT DOCUMENTS 3,600,714 A 8/1971 Cade et al.
4,136,403 A * 1/1979 Walther ..... A62B 18/084 2/10
(Continued)

FOREIGN PATENT DOCUMENTS

DE 8601332 6/1986

OTHER PUBLICATIONS

NOCSAE. Standard Performance Specification for Newly Manufactured Football Helmets. National Operating Committee on Standards for Athletic Equipment: NOCSAE DOC (ND)002-13m13, 2013.
(Continued)

*Primary Examiner* — Richale L Quinn
(74) *Attorney, Agent, or Firm* — Thomas|Horstemeyer, LLP

(57) ABSTRACT

In one embodiment, a tether system for use with a protective helmet worn by a user includes multiple tethers, each tether having a first end adapted to attach to a shell of the protective helmet and a second end adapted to attach to an article worn by the user, wherein the tethers limit movement of the helmet.

15 Claims, 9 Drawing Sheets

(51) Int. Cl.

| | |
|---|---|
| ***A42B 3/12*** | (2006.01) |
| ***A42B 3/20*** | (2006.01) |
| ***A63B 71/10*** | (2006.01) |
| ***A63B 71/12*** | (2006.01) |

(52) U.S. Cl.
CPC ..... *A42B 3/127* (2013.01); *A42B 3/20* (2013.01); *A63B 71/10* (2013.01); *A63B 71/12* (2013.01)

(56) References Cited

U.S. PATENT DOCUMENTS

| | | | | |
|---|---|---|---|---|
| 6,029,962 | A | 2/2000 | Shorten et al. | |
| 7,921,475 | B2 | 4/2011 | Nascimento et al. | |
| 8,069,498 | B2 | 12/2011 | Maddux et al. | |
| 8,387,164 | B2 | 3/2013 | Maddux et al. | |
| 9,949,523 | B2 * | 4/2018 | Klein | A42B 3/20 |
| 10,092,057 | B2 * | 10/2018 | Kovarik | A42B 3/20 |
| 10,188,168 | B2 * | 1/2019 | Tubbs | A42B 3/20 |
| 10,244,809 | B2 * | 4/2019 | Linares | A42B 3/064 |
| 2006/0059606 | A1 | 3/2006 | Ferrara | |
| 2008/0163410 | A1 * | 7/2008 | Udelhofen | A42B 3/20 2/413 |
| 2013/0185837 | A1 | 7/2013 | Phipps et al. | |
| 2014/0007322 | A1 | 1/2014 | Marz et al. | |
| 2014/0053324 | A1 | 2/2014 | Jackson | |
| 2015/0201695 | A1 * | 7/2015 | Shih | A63B 71/10 2/9 |

OTHER PUBLICATIONS

PCT Patent Application PCT/US2015/060225 filed on Nov. 11, 2015, International Search Report and Written Opinon dated Feb. 3, 2016.

PCT Patent Application PCT/US2015/060226 filed on Nov. 11, 2015, International Search Report and Written Opinon dated Jan. 13, 2016.

PCT Patent Application PCT/US2015/060227 filed on Nov. 11, 2015, International Search Report and Written Opinion dated Jan. 13, 2016.

PCT Patent Application PCT/US2016/012544 filed on Jan. 7, 2016, International Search Report and Written Opinion dated Jun. 10, 2016.

Rowson, S. and Duma, S. M., (2011). Development of the STAR Evaluation System for Football Helmets: Integrating Player Head Impact Exposure and Risk of Concussion. Annals of biomedical engineering, 39(8), 2130-2140.

Rowson, S., Duma, S. M., Beckwith, J. G., Chu, J. J., Greenwald, R. M., Crisco, J. J., . . . & Maerlender, A. C. (2012). Rotational Head Kinematics in Football Impacts: An Injury Risk Function for Concussion. Annals of Biomedical Engineering, 40(1), 1-13.

United States. Department of Defense. Technology Readiness Assessment (TRA) Guidance. Revised. May 2011.

* cited by examiner

PROTECTIVE HELMETS HAVING ENERGY ABSORBING TETHERS

CROSS-REFERENCE TO RELATED APPLICATION

This application is the 35 U.S.C. § 371 national stage application of PCT Application No. PCT/US2015/060227, filed Nov. 11, 2015, where the PCT claims priority to U.S. Provisional Application Ser. No. 62/078,007, filed Nov. 11, 2014, both of which are herein incorporated by reference in their entireties.

BACKGROUND

Sports concussion and traumatic brain injury have become important issues in both the athletic and medical communities. As an example, in recent years there has been much attention focused on the mild traumatic brain injuries (concussions) sustained by professional and amateur football players, as well as the long-term effects of such injuries. It is currently believed that repeated brain injuries such as concussions may lead to diseases later in life, such as depression, chronic traumatic encephalophathy (CTE), and amyotrophic lateral sclerosis (ALS).

Protective headgear, such as helmets, is used in many sports to reduce the likelihood of brain injury. Current helmet certification standards are based on testing parameters that were developed in the 1960s, which focus on the attenuation of linear impact and prevention of skull fracture. An example of a linear impact is a football player taking a direct hit to his helmet from a direction normal to the center of his helmet or head. Although the focus of headgear design has always been on attenuating such linear impacts, multiple lines of research in both animal models and biomechanics suggest that both linear impact and rotational acceleration play important roles in the pathophysiology of brain injury. Although nearly every head impact has both a linear component and a rotational component, rotational acceleration is greatest when a tangential blow is sustained. In some cases, the rotational acceleration from such blows can be substantial. For instance, a football player's facemask can act like a lever arm when impacted from the side, and can therefore apply large torsional forces to the head, which can easily result in brain trauma.

Although the conventional wisdom is that the components of modern protective headgear that are designed to attenuate linear impact inherently attenuate rotational acceleration, the reality is that such components are not designed for that purpose and therefore do a relatively poor job of attenuating rotational acceleration. It therefore can be appreciated that it would be desirable to have means for attenuating not only linear impacts to but also rotational accelerations of the head, so as to reduce the likelihood of brain injury.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
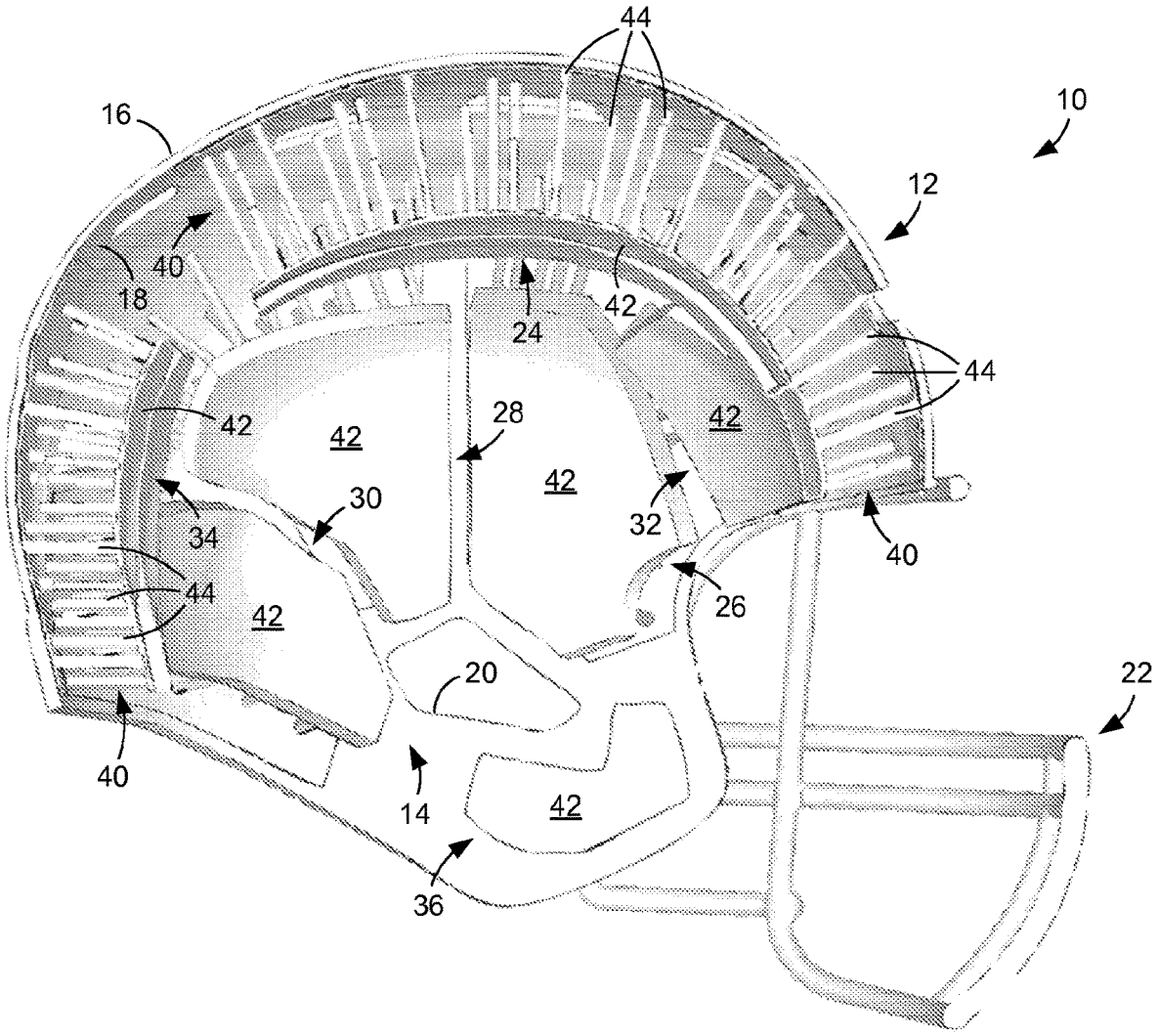
FIG. 1 is a cross-sectional side view of an embodiment of a protective helmet.

As described above, current protective headgear is primarily designed to attenuate linear impact. However, it has been determined that both linear impact and rotational acceleration from torsional forces contribute to brain injury, such as concussion. Disclosed herein are energy absorbing systems that comprise means for absorbing energy from impacts to a protective helmet that minimize both translational and rotational accelerations experienced by the head of the helmet wearer. In some embodiments, these means comprise an inner liner that includes energy absorbing columns that are designed bend and buckle to attenuate both translational and rotational accelerations. In some embodiments, the means comprise energy absorbing outer shell that locally deforms upon hard impacts to absorb energy. In some embodiments, the means comprise an energy absorbing tether system that limits linear movement and rotation of the helmet upon hard impact. These various means can be used independently of each other or in conjunction with each other to protect the helmet wearer.

In the following disclosure, various specific embodiments are described. It is to be understood that those embodiments are example implementations of the disclosed inventions and that alternative embodiments are possible. All such embodiments are intended to fall within the scope of this disclosure.

Described below are energy absorbing systems that can be incorporated into protective helmets that not only address linear forces but also tangential forces that cause the highest shear strains on the brain and the brain stem. By optimizing protection from both linear impacts and rotational acceleration, the transmission of shear force to the brain from head impacts can be reduced and so can the incidence of brain injury, such as concussion.

In some embodiments, a protective helmet can be provided with an energy absorbing inner liner that utilizes energy absorbing columns having various lengths and/or cross-sectional dimensions that are sandwiched between two elastomeric layers. The use of columns of varying lengths and/or cross-section dimensions enables protection against impacts over a range of energy levels. When columns of different lengths are used, low-energy impacts will activate only the tallest columns, which are connected to both layers, resulting in low translational accelerations. Higher energy impacts, however, will also activate shorter columns, which are connected to only one layer to prevent bottoming out and unacceptably high translational accelerations. The liner can be designed to provide optimal stiffness by tuning the distribution of columns to control the peak accelerations applied to the wearer's head during impact.

As disclosed herein, the inner liner uses controlled buckling and bending of the columns to mitigate both linear and rotational accelerations experienced by the wearer's head. Traditional column buckling is a velocity-dependent process that produces high initial forces that drop very low as the column deforms. This fundamental behavior must be overcome if columns are to become an efficient energy absorber for use in protective helmets and other protective equipment. One important advantage of precise column buckling that makes it attractive for use as a helmet liner is the directionality of its resistance forces during oblique impacts that apply rotational moments to the helmet. During this type of impact, the top of the column pushes the helmet in the direction of the applied moment while pushing the player's head in the opposite direction. An advance of the disclosed liners is that linear impact dissipation can be optimized without adversely affecting the rotational behavior of the columns.

A column buckles when the eccentricity, or misalignment, over its length produces a bending moment in the center of the column that overcomes its bending stiffness. Hence, dynamic buckling utilizes forces from axial loading to push the middle of the column laterally. Unless the misalignment is very large, these lateral forces are small relative to the mass of the column. As a result, the column produces a large inertial impulse while dynamic buckling is initiated. This type of impulse can produce dangerous acceleration forces on the player's head. In some embodiments, the disclosed inner liner overcomes this problem using multiple features. First, the columns of the inner liner can be made of an elastomeric material that provides some level of axial compression during the period in which buckling is initiated to compensate for the magnitude of the inertial spike.

Second, the columns can be eccentric relative to the layers between which they lie to reduce the load required to initiate column buckling. These eccentricities take the form of a misalignment of the column ends from the normal direction of the layers so that the columns will have a moment applied upon the onset of loading. This misalignment also results in additional stroke because it can cause the column halves to fold beside themselves as they collapse rather than stacking on top of themselves. Furthermore, the curvature of the inner liner due to the curved nature of the helmet results in further eccentricity in the columns because it is likely that only a small portion of the activated columns will be normal to the impact direction, thus any inertial forces coming from these columns would be small in comparison to the overall forces generated by the sum of activated columns.

Third, as mentioned above, the column lengths can be varied. Varying column lengths accomplishes two goals. Firstly, it spreads out the inertial impulse to eliminate the high inertial spike during the early stages of impact. Secondly, it enables the liner stiffness to be increased with higher deflections.

FIG. 1 illustrates an example embodiment of a protective helmet 10 that is designed to attenuate both linear impact and rotational accelerations. The helmet 10 shown in FIG. 1 is generally configured as an American football helmet. Although that particular configuration is shown in the figure and other figures of this disclosure, it is to be understood that a football helmet is shown for purposes of example only and is merely representational of an example protective helmet. Therefore, the helmet need not be limited to use in football. Other sports applications include baseball and softball batting helmets, lacrosse helmets, hockey helmets, ski helmets, bicycling and motorcycle helmets, and racecar helmets. Furthermore, the helmet need not even be used in sports. For example, the helmet could be designed as a construction or military helmet. It is also noted that the principles described herein can be extended to protective equipment other than helmets. For example, features described below can be incorporated into protective pads or armor, such as shoulder pads, hip pads, thigh guards, shin guards, cleats, and other protective equipment in which energy absorption could be used to protect the wearer.

With continued reference to FIG. 1, the helmet 10 generally includes an outer shell 12 and an inner liner 14. In the illustrated embodiment, the shell 12 is shaped and configured to surround the wearer's head with the exception of the face. Accordingly, the shell 12, when worn, extends from a point near the base of the wearer's skull to a point near the wearer's brow, and extends from a point near the rear of one side of the wearer's jaw to a point near the rear of the other side of the wearer's jaw. In some embodiments, the shell 12 is unitarily formed from a generally rigid material, such as a polymer or metal material. Example materials are described below in relation to FIGS. 9A and 9B.

Irrespective of the material used to construct the shell 12, the shell includes an outer surface 16 and an inner surface 18. In some embodiments, the shell 12 can further include one or more ear openings 20 that extend through the shell from the outer surface 16 to the inner surface 18. The ear openings 20 are provided on each side of the shell 12 in a position in which they align with the wearer's ears when the helmet 10 is donned. Notably, the shell 12 can include other openings that serve one or more purposes, such as providing airflow to the wearer's head.

As is further shown in FIG. 1, a facemask 22 can be secured to the front of the helmet 10 to protect the face of the wearer. In some embodiments, the facemask 22 can comprise one or more rod-like segments that together form a protective lattice or screen. When used, the facemask 22 can, for example, be attached to the helmet 10 at points that align with the forehead and jaw of the wearer when the helmet is worn. The facemask 22 can be attached to the helmet 10 using screws (not shown) that thread into the shell 12 or into fastening elements (not shown) that are attached to the helmet. Although a particular facemask configuration is shown in the figures, alternative configurations are possible. Moreover, the facemask 22 can be replaced with a face shield or other protective element, if desired.

The inner liner 14 generally comprises one or more pads that sit between the shell 12 and the wearer's head when the helmet 10 is worn. In some embodiments, each of the pads is removable from the helmet. For instance, the pads can be configured to releasably attach to the inside surface 18 of the helmet shell 16 with snap, T-nut, or hook-and-loop fasteners. In the illustrated embodiment, the pads include a top pad 24, multiple lateral pads 26, 28, and 30, a front pad 32, a rear pad 34, and jaw pads 36. The top pad 24 is adapted to protect the top of the wearer's head. In the illustrated embodiment, the top pad 24 is elongated in a direction that extends along the sagittal plane of the wearer so as to extend from a rear top portion of the head to a front top portion of the head. The top pad 24 is further curved to generally follow the curvature of the wearer's head. Accordingly, the top pad 24 forms a concave inner surface that is adapted to contact the wearer's head.

The lateral pads 26-30 are adapted to protect the sides of the wearer's head. The lateral pads 26-30 extend from the edges of the wearer's face to points behind (and above) the user's ears. Like the top pad 24, the lateral pads 26-30 are curved to follow the curvature of the shell 12 and the wearer's head. Accordingly, the lateral pads 26-30 form concave inner surfaces that are adapted to contact the wearer's head.

The front pad 32 is positioned within the outer shell 12 so as to protect the forehead of the wearer. Like the other pads, the front pad 32 is curved to follow the curvature of the wearer's head. The forward pads 30 therefore form concave inner surfaces that are adapted to contact the wearer.

The rear pad 34 is adapted to protect the rear of the wearer's head. The rear pad 28 is also curved to follow the curvature of the wearer's head and forms a concave inner surface that is adapted to contact the wearer's head.

The jaw pads 36 are adapted to protect the jaw of the wearer. As with the other pads, the jaw pad 36 can curved to follow the curvature of the wearer's head and forms a concave inner surface that is adapted to contact the wearer's head.

Several or all of the above-described pads can be of similar construction. In some embodiments, each of the pads comprise an outer energy absorber 40 that is adapted to absorb translational and rotational energy from helmet impacts and an inner cushion 42 that is adapted to provide comfort to the wearer's head. The energy absorbers 40 releasably attach to the inner surface 18 of the shell 12. Details about the construction of the energy absorbers 40 are provided below in relation to FIGS. 2-8. It suffices to say at this point, however, that the energy absorbers 40 include energy absorbing columns 44 that dissipate translational and rotational accelerations.

The inner cushions 42 of the pads contact or are at least adjacent to the wearer's head and/or face when the helmet 10 is donned. The cushions 42 can have any construction that is comfortable for the wearer. In some embodiments, the cushions 42 are foam cushions. In other embodiments, the cushions 42 are air bladder cushions.

Figure 2A:
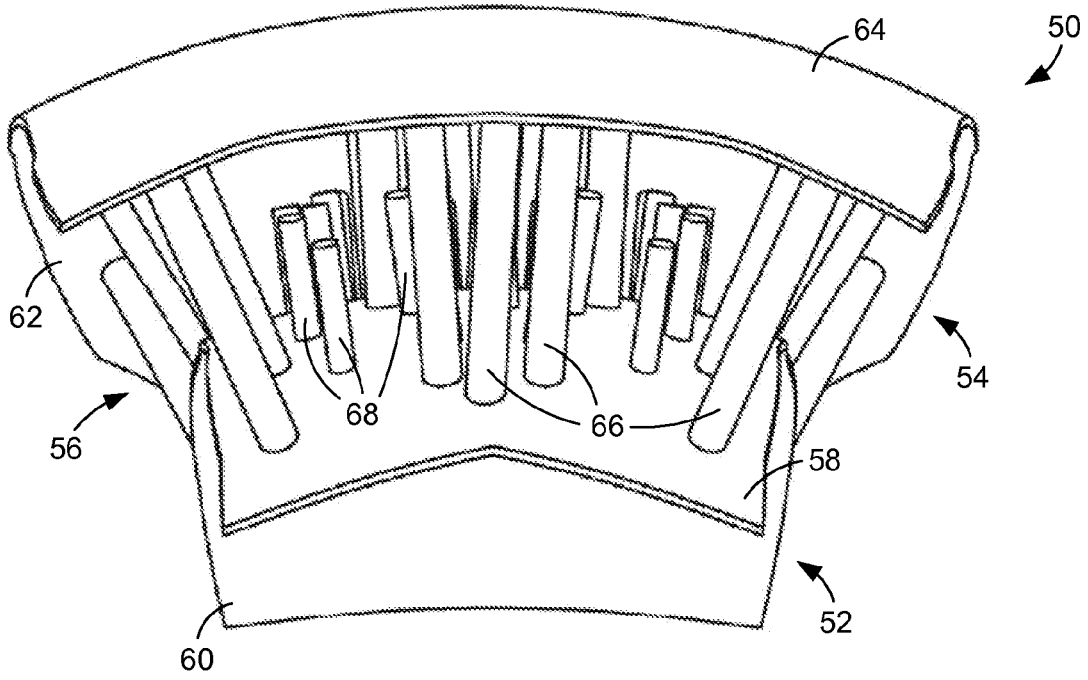
FIG. 2A is a front view of an embodiment of an energy absorber that can be used in the helmet of FIG. 1.
Figure 2B:
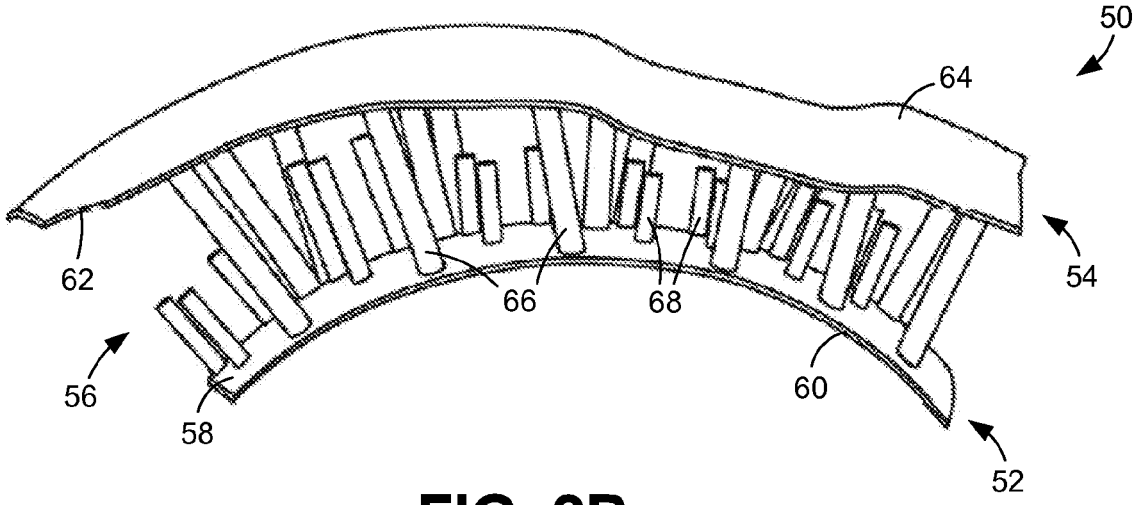
FIG. 2B is a side view of the energy absorber of FIG. 2A.

FIGS. 2A and 2B illustrate an example energy absorber 50 that can be used in a pad that forms part of a helmet liner, such as the inner liner 14 shown in FIG. 1. As shown in FIGS. 2A and 2B, the energy absorber 50 generally comprises a first or inner layer 52, an opposed second or outer layer 54, and a plurality of energy absorbing columns 56 that are provided between the layers, which can bend and buckle to absorb energy. As illustrated in the figures, the inner and outer layers 52, 54 comprise thin, generally planar members that are curved to conform to the curvature of the human head and the outer shell 12. In some embodiments, the layers 52, 54 have similar curvatures. The inner layer 52 comprises an inner surface 58 that faces the outer layer 54 and an outer surface 60 that faces the wearer's head and provides a surface to which an inner cushion 42 can be attached. The outer layer 52 comprises an inner surface 62 that faces the inner layer 52 and an outer layer 64 that can be attached to the inner surface 18 of the outer shell 12.

The energy absorbing columns 56 can comprise elongated cylindrical members that are substantially perpendicular to the inner and outer layers 52, 54. As is apparent in FIGS. 2A and 2B, the columns 56 can have various lengths or heights. Relatively long columns 66 connect the inner and outer layers 52, 54. Such columns 66 are attached at a proximal end (nearest the wearer's head) to the inner layer 52 and are attached at a distal end (nearest the shell 12) to the outer layer 54. Shorter columns 68 are only attached to one of the layers 52, 54. In the illustrated embodiment, the proximal ends of the shorter columns 68 are attached to the inner layer 52 while the distal ends of those columns are free ends. In addition to the lengths, the cross-sectional dimensions of the columns 56 can be varied.

In some embodiments, the energy absorber 50 can comprise columns of several different lengths. For example, the energy absorber 50 could incorporate columns 56 of 2, 3, 4, 5, or more different lengths, in which case the energy absorber provides multiple stages of energy dissipation. In such cases, relative mild impacts may only affect the longest columns 56 (i.e., the first stage of the energy absorber 50) while stronger impacts may affect columns of shorter lengths (i.e., other stages of the energy absorber). This multi-stage approach provides increased stiffness as the deflection of the energy absorber 50 increases, as well as reduction in the inertial spike that comes prior to the onset of buckling in the columns 56.

An important measure of energy absorber efficiency is the achievable absorber deflection divided by its original length. All multi-impact energy absorbers have a maximum useable deflection beyond which the stiffness becomes excessive. This difference is normally referred to as the stack-up distance. In some embodiments, the columns 56 are arranged within the energy absorber 50 in a manner that minimizes interaction between adjacent columns to minimize the possibility of the columns stacking on top of one another as the energy absorber compresses.

The thicknesses of the inner and outer layers 52, 54, the lengths and cross-sectional dimensions of the columns 56, and the ratio of columns attached to both layers versus attached to only one layer can be tailored to achieve a desired load capacity for the energy absorber 50 and the pad in which it will be used. Thicker layers 52, 54 will increase the load capacity of the columns 56 because of the stiffened end conditions, thereby enabling the use of thinner columns. However, thicker layers 52, 54 will also increase the overall mass of the inner liner 14 because the layers represent the highest volume of material in the system while also reducing the useable stroke. Thus, it is important to optimize the energy absorbers 50 to provide the desired outcome at each location within the helmet 10, taking into account factors such as available stroke, coverage area in the impact location, frequency of impact in the protected location, and overall liner mass. For instance, the front pad 32 (FIG. 1) may have larger diameter columns and a higher ratio of attached columns than other pads in the liner 14 to increase the pad stiffness due to the inherent weakness in the outer shell at that location and the increased need for protection in the frontal region due to the increased likelihood of impacts in that location.

In some embodiments, the outer layer 54 has a thickness of approximately 0.5 to 3 mm and may contain holes for fasteners or ventilation. In some embodiments, the inner layer 52 has a thickness of approximately 0.5 to 2.5 mm. In some embodiments, the energy absorbing columns 56 that are attached to both the inner and outer layers 52, 54 have lengths of approximately 18 to 65 mm and cross-sectional dimensions (e.g., diameters) of approximately 3 to 7 mm, while the columns that are attached to only one of the layers have lengths of approximately 8 to 55 mm and cross-sectional dimensions (e.g., diameters) of approximately 2 to 6 mm. In some embodiments, the fraction of columns 56 that are connected to both layers 52, 54 is approximately 15 to 40%, but can be increased to as much as 100% if the pad will undergo consistent loading and does not need to provide protection against a variety of impact conditions. While the columns 56 are illustrated in FIGS. 2A and 2B as having constant cross-sectional dimensions along their lengths, it is noted that these dimensions can vary along the lengths of the columns. For example, one or more columns 56 can have a larger cross-section at its base than at other points along its length.

Figure 3:
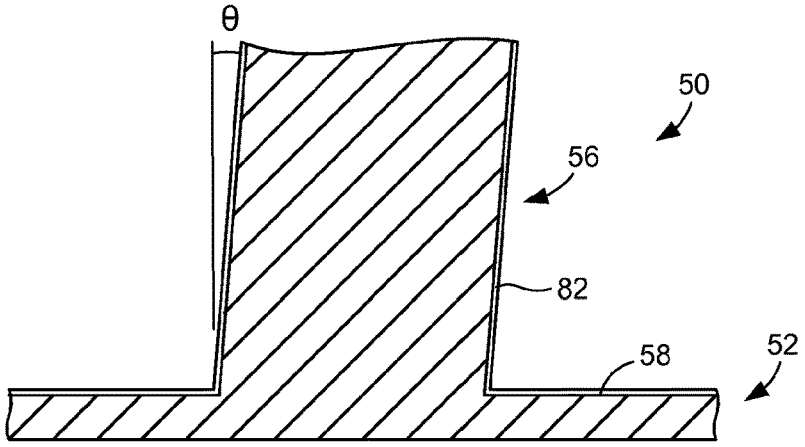
FIG. 3 is a partial detail view of an energy absorbing column of the energy absorber of FIG. 2.
Figure 4:
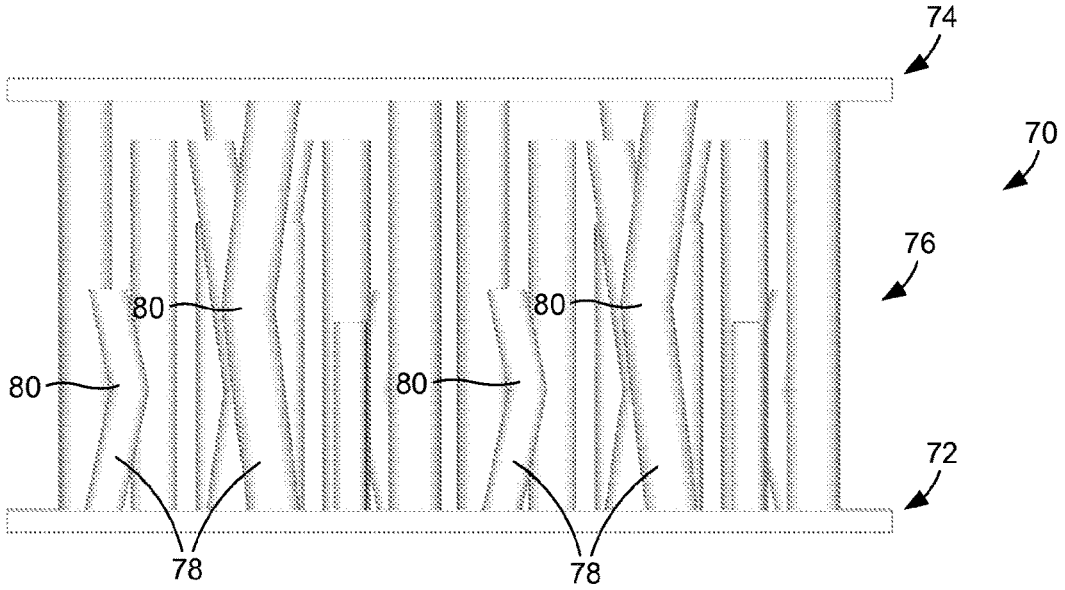
FIG. 4 is a side view of a further embodiment of an energy absorber that can be used in the helmet of FIG. 1.

In some embodiments, the columns 56 can be slightly eccentric to reduce the magnitude of the inertial spike that occurs upon impact. This eccentricity can come in the form of an angling of the columns 56 from the direction normal to the inner surface of the inner and/or outer layers 52, 54. FIG. 3 illustrates an example of this form of eccentricity. As shown in this figure, a column 56 is offset from the normal direction of the inner surface 58 of the inner liner 52 by an angle θ, which, for example, can be an acute angle up to approximately 15 degrees. Other possible forms of eccentricities include a predefined curve or kink manufactured into the columns. FIG. 4 illustrates an example of this. In this figure, an energy absorber 70 having an inner layer 72, and outer layer 74, and a plurality energy absorbing columns 76. Some of the columns 78 comprise a medial kink 80 that facilitates buckling.

Although the energy absorbing columns 56 have been described as comprising cylindrical members, which typically comprise circular cross-sections, it is noted that other cross-sectional geometries are possible. For example, the columns 56 can have an elliptical, polygonal, or other non-uniform cross-section. In addition, the columns 56 can have a twisted configuration in which the cross-section changes along the length of the columns. For example, if the column 56 had an elliptical cross-section, the orientation of the ellipse can rotate as the length of the column is traversed to form a twisted shape. Such a shape can force the columns 56 to twist while buckling, which both increases the energy dissipation rate in the later stages of collapse and forces the top half of the column to land beside the bottom half, which reduces the stack-up distance and maximizes available compression in the energy absorber.

Each of the inner liner 52, outer liner 54, and the energy absorbing columns 56 can be made of an elastomeric material. In some embodiments, these components are made of a thermoplastic elastomer (TPE), such as thermoplastic polyurethane (TPU). BASF Elastollan 1260D U is one commercial example of a TPU. Other suitable TPEs include copolyamides (TPAs), copolyesters (TPCs), polyolefin elastomers (TPOs), and polystyrene thermoplastic elastomers (TPSs).

TPU may be preferable for construction of the energy absorbers for a variety of reasons. This material can be made to be soft enough to provide consistent initiation of the buckling process, has a rapid relaxation time to assure high rates of energy dissipation, and has proven to be both durable and tolerant of large temperature variations. Both the viscoelastic nature of TPU and the sensitivity of column buckling to impact speed enable the energy absorbing columns to absorb greater amounts of energy as impact speed increases. This is important for helmets that must attenuate high speed impacts and simultaneously provide optimum protection of helmet wearers who experience large numbers of low speed impacts. Furthermore, TPU is a low cost, versatile, and commercially available material. It offers a long list of performance characteristics that are desirable in an environment involving energy management, such as athletic equipment and military applications. For instance, all grades of unreinforced TPU have high elasticity with elongation to break values of 300 to 1000%, tensile strength to yield of 10 to 45 MPa, hardness values of 52 to 98 on the Shore A scale and 22 to 95 on the Shore D scale, and material densities in the range of 1.05 to 1.53 g/cc.

TPU also has a low glass transition temperature of −69 to −17° C., meaning that it will retain its elastic properties over the a broad range of temperatures, such as that in which sports are played. In addition, TPU provides excellent abrasion resistance, impact strength, weather resistance, and antimicrobial properties. Additionally, TPU can be modified to suit a particular application by adding fillers, colorants, or stabilizers. One desirable performance characteristic is that TPU can be optimized to achieve effective damping with optimal rebound speed (e.g. short relaxation time). Finally, TPU provides fabrication flexibility, can be injection molded, and can be bonded or welded though a variety of processes.

One potential problem associated with varying column length is the possibility that shorter columns will slide, resulting in a bending mode of failure rather than buckling. The bending failure mode greatly reduces energy dissipation rates. To combat this issue, a texture can be added to the inner surfaces of the inner and outer layers as well as the outer surfaces of the columns. Such a texture is schematically illustrated in FIG. 3 as texture 82 and can cause the columns to lock in place once contact is made with other columns and/or the inner and/or outer layers. In some embodiments, the texture 82 can comprise a rough surface that is formed on the layers/columns during energy absorber fabrication (e.g., injection molding). In other embodiments, this texture 82 can comprise a geometric (e.g., metal) mesh that is integrated into the surfaces during fabrication (e.g., injection molding).

In some embodiments, the energy absorbers can be manufactured in two parts. The first part can comprise the outer layer and all the necessary features for attaching the energy absorber to the outer shell 12, while the second part can comprise the inner layer and the columns that are connected thereto. The two parts can be produced through injection molding or another commercial manufacturing process. Once formed, the two parts can be bonded together through use of welding or an adhesive. Alternatively, the layers and columns could each be manufactured as separate parts. In such a case, the columns can comprise notches at their ends that enable them to be snapped into place into pre-formed holes in the inner and outer layers. The columns could then be bonded to the layers through welding or adhesion.

Figure 5:
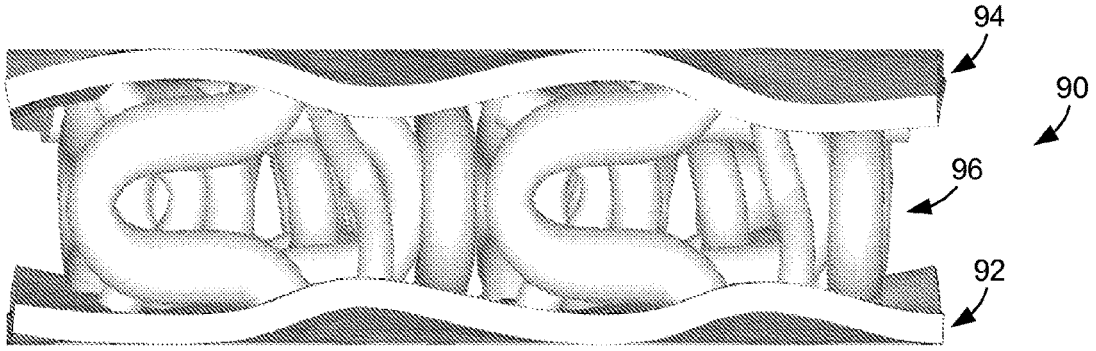
FIG. 5 is a side view of a compressed energy absorber illustrating bending and buckling of its energy absorbing columns.

As discussed above, the energy absorbers are designed to deform upon impact to dissipate energy. FIG. 5 illustrates such deformation. As shown in this figure, an energy absorber 90 comprises an inner layer 92, an outer layer 94, and a plurality of energy absorbing columns 96. The outer layer 94 has been pushed in toward the inner layer 92 because of an external (downward) force and, as a result, the columns 96 of the energy absorber 90 have bent and/or buckled under this force, thereby dissipating energy.

Figure 6A:
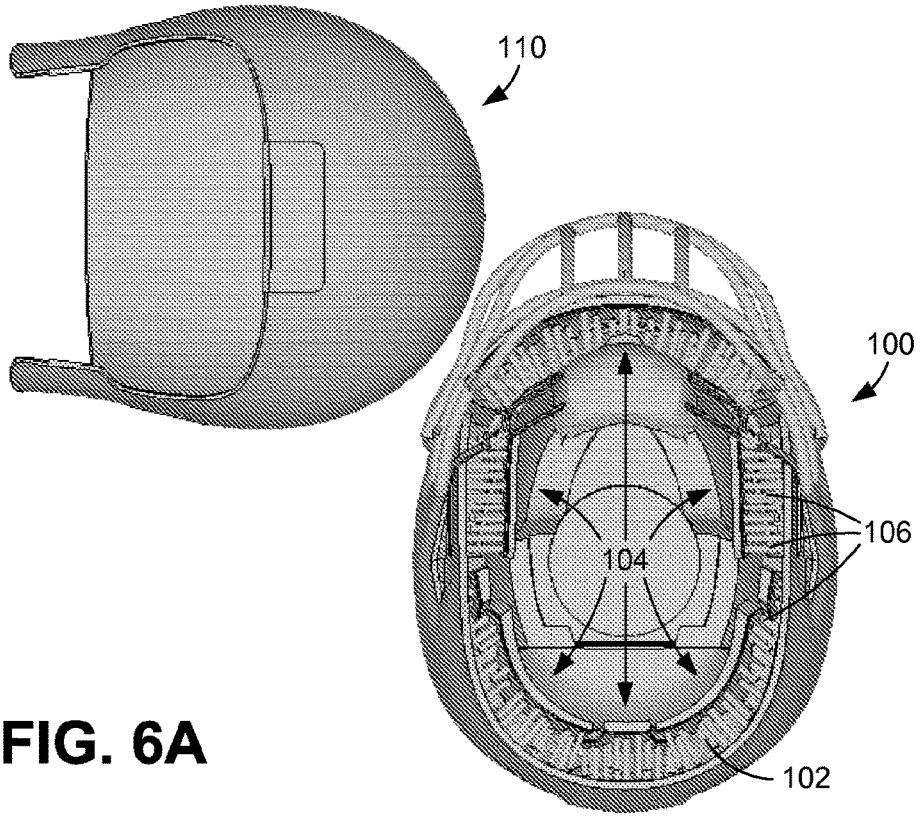
FIG. 6A is a bottom view of a protective helmet of the type shown in FIG. 1 immediately prior to impact from another helmet.
Figure 6B:
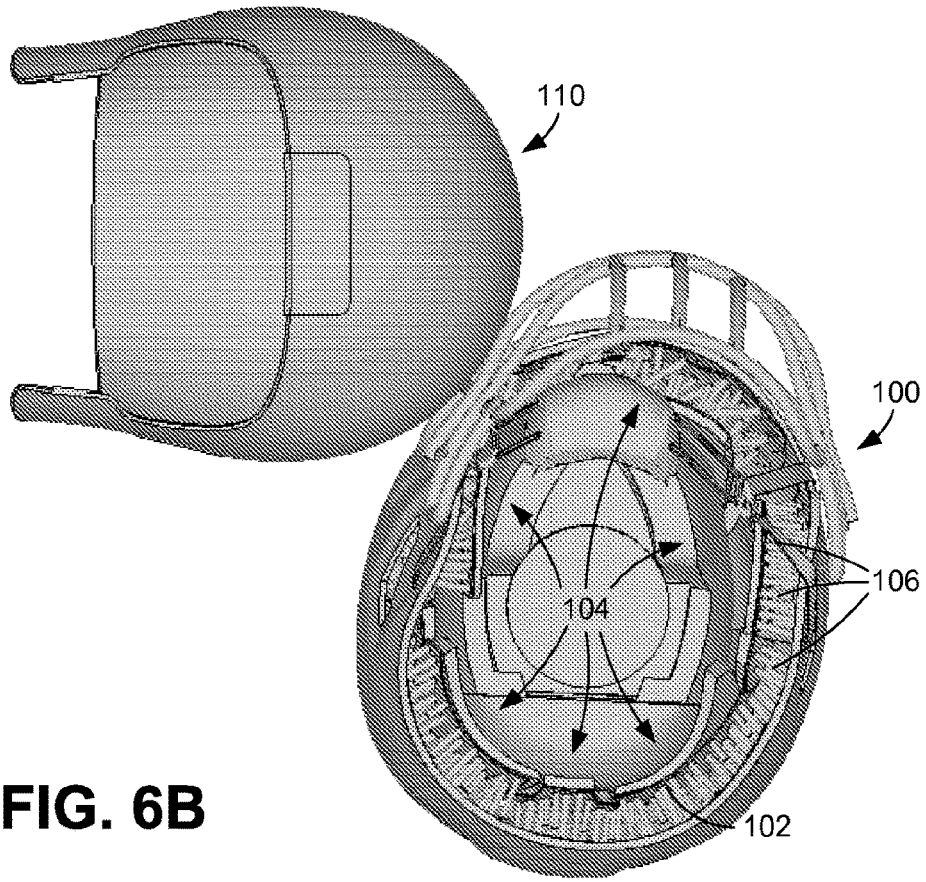
FIG. 6B is a bottom view of the protective helmet of FIG. 6A during an impact from another helmet.

FIGS. 6A and 6B illustrate operation of the energy absorbers when incorporated into a protective helmet 100.

As is apparent in this figures, the helmet 100 includes an inner liner 102 comprising multiple pads 104 having energy absorbing columns 106. FIG. 6A shows the helmet 100 prior to impact. In this state, the helmet 100 is centered on the wearer's head. FIG. 6B shows the helmet 100 upon receiving a tangential impact from another helmet 110. As can be appreciated from this figure, the energy absorbing columns 106 near the point of impact have deformed to absorb the energy of the impact. In addition, the helmet 100 has rotated relative to the wearer's head to dissipate the rotational force imparted by the helmet 110 instead of delivering it directly to the wearer's head. In such a case, the wearer's head can remain relatively stationary, at least in terms of rotation, while the helmet 100 rotates. Once the force is removed, however, the energy absorbing columns 106 can return the helmet 100 to its original orientation on the head.

Figure 7:
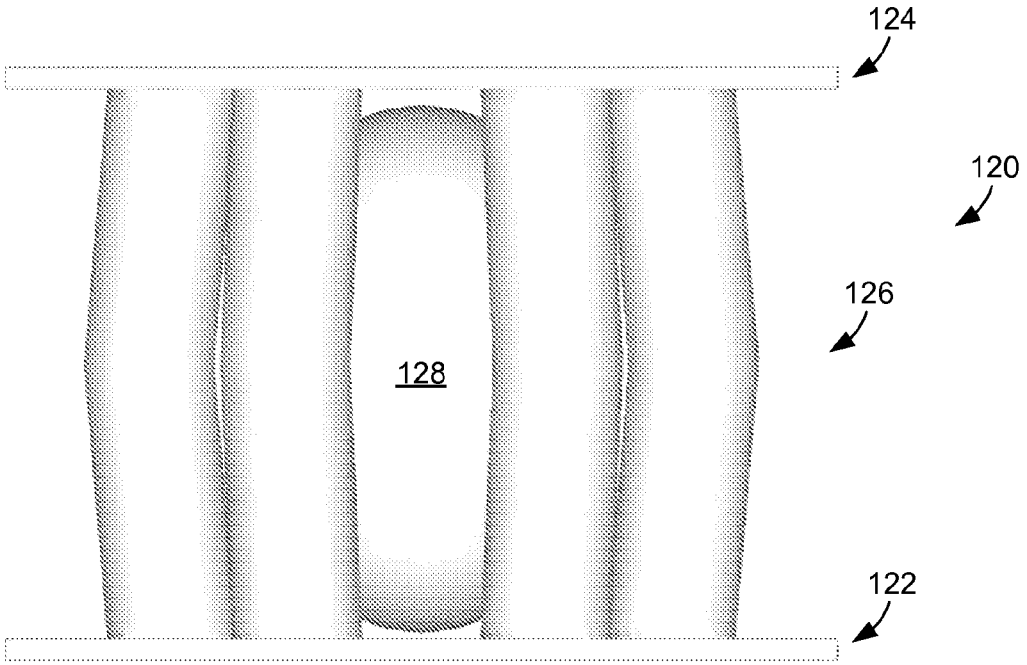
FIG. 7 is a side view of a further embodiment of an energy absorber that can be used in the helmet of FIG. 1.

It is noted that the energy absorbers can comprise other components besides columns between their inner and outer layers. For example, FIG. 7 illustrates an energy absorber 120 comprising an inner layer 122, an outer layer 124, and a plurality of energy absorbing columns 126. Provided between the inner and outer layers 122, 124 in a free space between the columns 126 is a supplemental energy absorbing member 128. The member 128 can comprise a foam element or an air bladder element that provides increased energy dissipation where needed, such as near the front of a helmet. In the illustrated embodiment, the member 128 is generally elliptical with its long axis extending along the normal directions of the inner and outer layers 122, 124.

The basic premise of impact energy management is to optimize energy absorption in each component of a system. So, while the inner liners described above can be used to absorb energy, other components of the helmet can likewise be designed to absorb energy. Once such component is the outer shell of the helmet.

The shell material in most commercial football helmets is made of polycarbonate (PC) alloys or acrylonitrile butadiene styrene (ABS) plastic in thicknesses ranging from 3 to 4 mm. While these materials have high impact resistance, they exhibit a highly elastic response to impacts. Therefore, the energy absorbed by the shell material is minimal. Greater energy could be absorbed, however, if the shell was made of a deformable, energy absorbing material.

With reference back to FIG. 1, the outer shell 12 of the protective helmet 10 can be made of such a material. In some embodiments, the shell 12 is made of a polyethylene (PE) composition, such as high density polyethylene (HDPE). HDPE is a class of thermoplastic polymers that incorporate long chains of polyethylene mers with molecular weights in the range of approximately 100,000 to 3,000,000. HDPE is a suitable replacement for the elastic PC or ABS materials used in current football helmets, whether or not the helmets include an inner liner of the nature described above.

A protective helmet must meet the requirements under its working conditions. Football helmets are required to absorb energy, resist gouging, fatigue, and creep, operate in extreme ambient temperatures (−12° C. and 52° C.), accept paint and dyes, and be readily manufacturable. HDPE is a low-cost, versatile, and commercially available material. It offers a long list of performance characteristics that are desirable in an environment involving energy management, such as athletic equipment and military applications. Specific parameters of a suitable HDPE composition include the following:

Tensile Strength to Yield: ~25-31 MPa
Rockwell Hardness (Shore D): ~55-75
Elongation to Break: ~900-1300%
Flexural Modulus: ~1000-1500 MPa
Melt Flow Index: ~5 to 8 g/10 minutes Additionally, HDPE offers a lower density (0.95 g/cm$^3$) when compared to conventional PC (1.2 g/cm$^3$) or ABS (1.05 g/cm$^3$) formulations. A lower density can be advantageous by providing lower weight to the wearer or a thicker geometry for the same weight. In some embodiments, the shell has a thickness of approximately 2.4 to 4 mm. HDPE also offers a low glass transition temperature of −70° C. to −80° C.

It is important to note that energy absorbing outer shells can be too soft. If the local deformation of the shell is too high, impacting helmets can become entangled or interlocked such that high forces can be generated parallel to the surface of the shell. This type of loading produces high rotational accelerations in the helmet. High rotational accelerations are also produced when hard accessories, such as fasteners, gouge into the surface of the shell material. Typical HDPE's may not offer sufficient slip (low friction) or abrasion resistance to counter mechanical interlock as described above. The polyethylene of the HPDE can be compounded with one or more additives to combat these issues. Such additives can include a processing stabilizer that protects the polymer at high temperatures, a heat stabilizer that inhibits degradation of the end product, a slip agent that reduces friction between surfaces (i.e., increases slip), and an ultraviolet stabilizer that inhibits environmental degradation. ADDCOMP ADD-VANCE 148 and 796 are two example commercial multi-functional additives that could be used. A range of approximately 1 to 8% by weight of the additives can be compounded with the PE base in the composition.

Football helmet shells are often dyed in a similar color in which they will be painted or coated after manufacturing. The HDPE composition described herein can readily accept up to 3.5% by weight, which is suitable for the range of colors on the market. Once a HDPE helmet has been manufactured, its surface energy can be increased by 2-5 dynes/cm through corona treatment or other processes to impart wettability, which enables paint particles to adhere to the helmet.

Figure 8A:
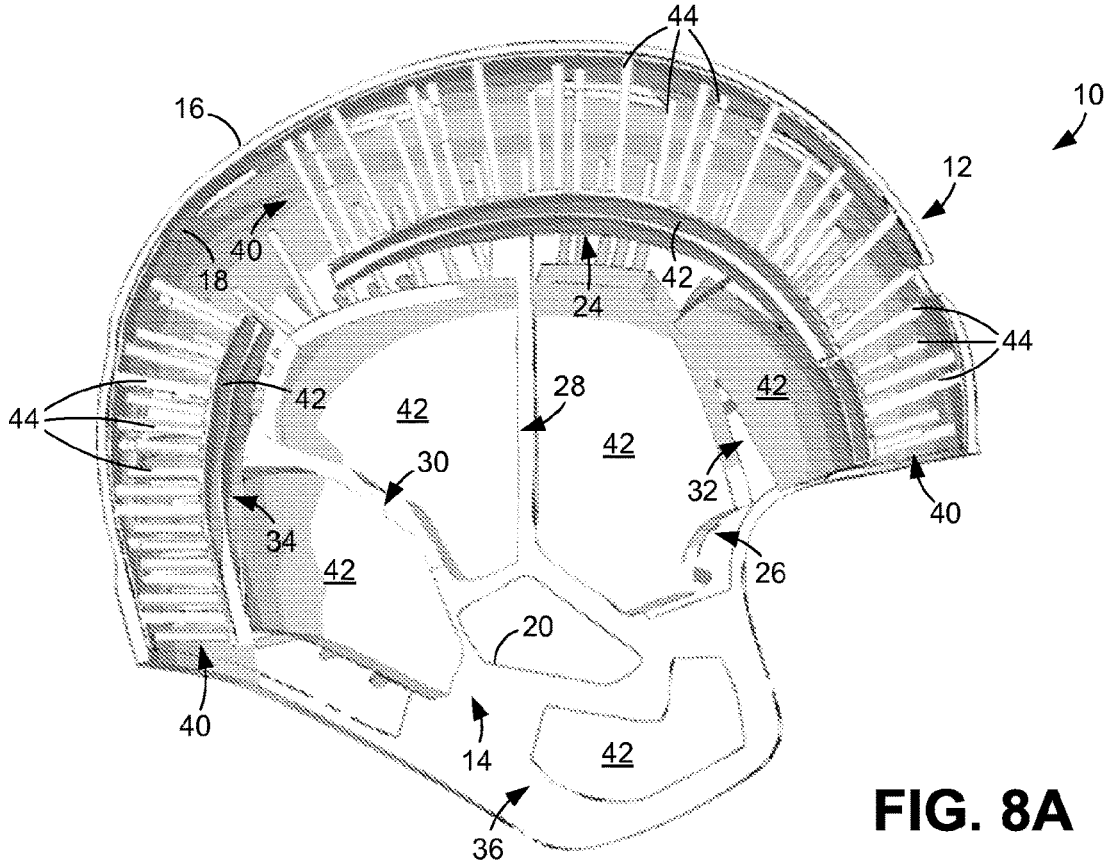
FIG. 8A is a cross-sectional side view of a protective helmet incorporating an energy absorbing outer shell immediately prior to an impact.
Figure 8B:
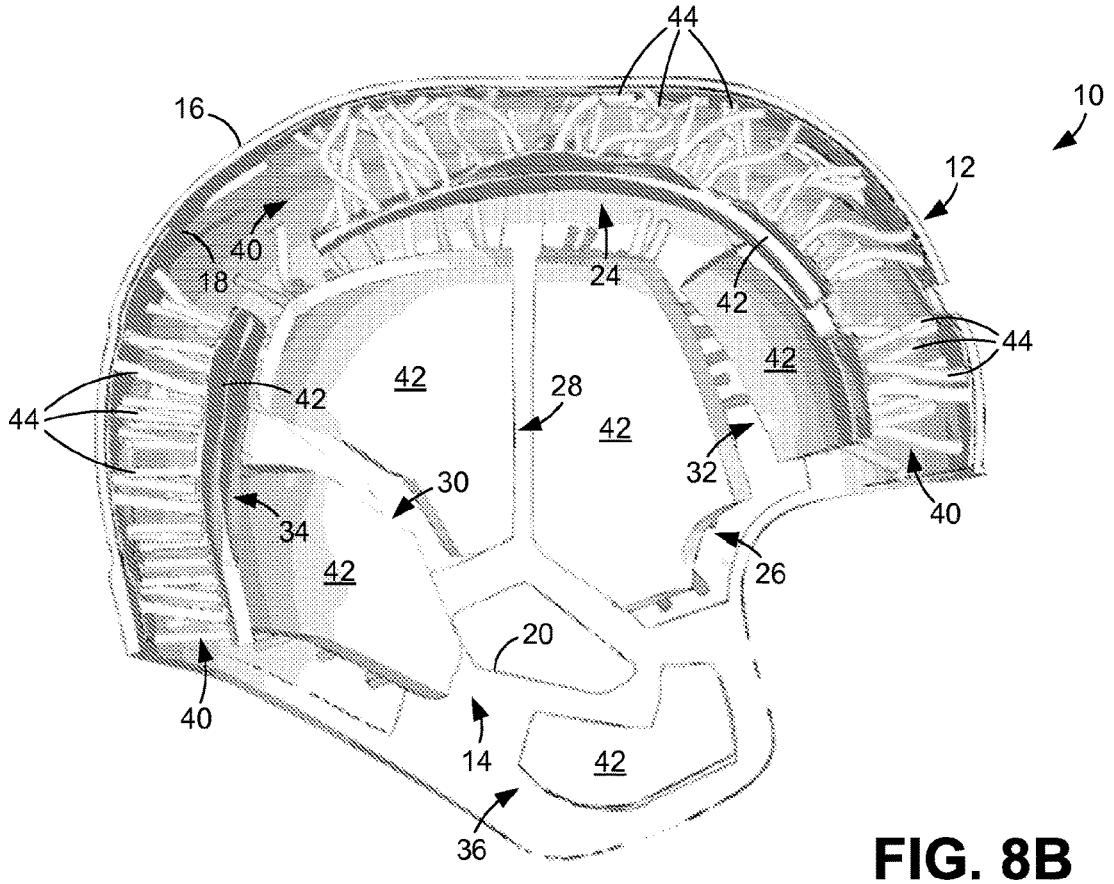
FIG. 8B is a cross-sectional side view of the protective helmet of FIG. 8B during the impact.

FIGS. 8A and 8B illustrate the effect of constructing the outer shell 12 of the protective helmet 10 out of an energy absorbing material, such as HDPE. FIG. 8A shows the helmet 10 prior to impact. FIG. 8B shows the helmet 10 upon receiving an impact to the top of the shell 12. As can be appreciated from this figure, the shell 12 has locally deformed at the point of impact and thereby dissipates some of the impact force. As before, the energy absorbing columns 56 have also deformed near the point of impact.

Another way in which energy imparted to a protective helmet can be absorbed is tethering of the helmet. Tethering a helmet involves attaching one or more flexible tethers between the wearer's helmet and an object securely anchored to the wearer's body. Such tethers greatly increase the helmet's resistance to motion by firmly securing the helmet to the wearer's upper body. If properly designed, tethers can reduce peak accelerations by as much as 80 percent by raising the effective mass of the head and helmet from approximately 13 lbs. to over 70 lbs.

An effective helmet tether system can incorporate the following features: A) enables the head/neck complex to freely rotate and posterior flex when not being struck; B) provides resistance to acceleration when helmet is struck; C) cannot apply excessive force to helmet; D) cannot obstruct players vision; and E) easily attaches and detaches from the helmet.

A helmet tether system can be designed as a passive or an active system. Passive tether systems are designed to resist extreme motions, such as excessive deflection or velocity. Active tether systems, however, incorporate sensors that sense when an impact has either begun or is about to occur and includes actuation mechanisms that actively respond to such sensed conditions.

Figure 9:
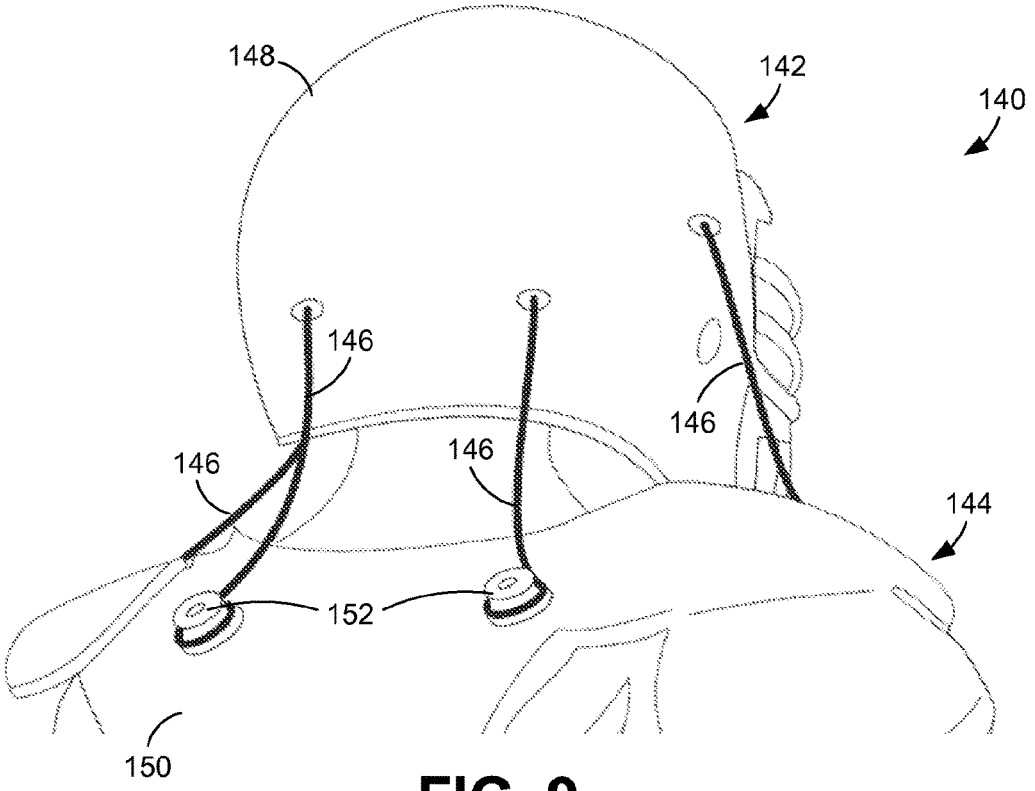
FIG. 9 is a rear perspective view of a first embodiment of a passive helmet tether system.

FIG. 9 illustrates a first embodiment of a passive helmet tether system 140 that links a protective helmet 142 to an article 144 (shoulder pads in this example) worn by the helmet wearer. The system 140 includes multiple tethers 146 that extend between the helmet 142 and the shoulder pads 144. More particularly, a first or upper end of each tether is attached to the interior or exterior of the outer shell 148 of the helmet 142, and a second or lower end of each tether is attached to the outer shells 150 of the shoulder pads 144. In the illustrated embodiment, the lower ends of the tethers 146 are attached to and wrapped around spools 152 that are fixedly mounted to the shoulder pad outer shells 150. The spools 152 are free to rotate to enable lengthening of the tether 146 to enable turning of the head until the maximum length has been reached, at which point the tether limits further helmet movement. By limiting the degree to which the helmet 142 can be move relative to the body, the tether system 140 limits the forces that can be transmitted to the wearer's head. In some embodiments, the tethers 146 comprise high-strength, flexible, inelastic cords. Example inelastic cord materials include steel, nylon, polypropylene, and polyethylene.

In some embodiments, the spools 152 can comprise internal torsion springs (not shown) that take up any slack that forms in the tethers 146. In other embodiments, the spools 152 can further comprise internal locking mechanisms (not shown), such as centrifugal brakes, that automatically lock the angular orientations of the spools, and therefore halt lengthening of the tethers 146, upon a threshold angular acceleration being reached. The threshold angular acceleration can be one that is associated with movements of the helmet 142 that exceed the speed with which the wearer can move his or own head, which are indicative of a helmet impact.

Figure 10:
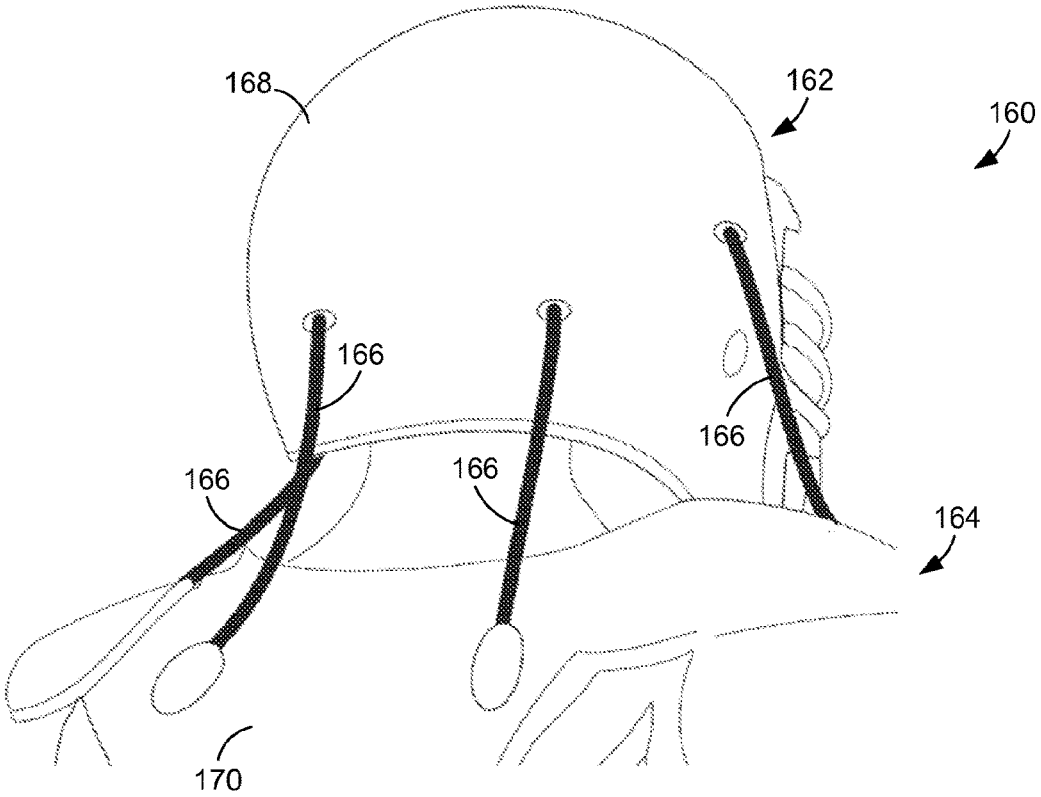
FIG. 10 is a rear perspective view of a second embodiment of a passive helmet tether system.

FIG. 10 illustrates a second embodiment of a passive helmet tether system 160 that links a protective helmet 162 to an article 164 (shoulder pads) worn by the helmet wearer. The system 160 is similar to the system 140 in that a first or upper end of each tether 166 is attached to the outer shell 168 of the helmet 162, and a second or lower end of each tether is attached to the outer shells 170 of the shoulder pads 164. However, this embodiment comprises no spools. Instead, the tethers 146 comprise flexible, elastic cords that resist movement as they are stretched. Example elastic cord materials include elastomers such as synthetic rubber, and TPU, and fiber-reinforced elastomers.

Figure 11:
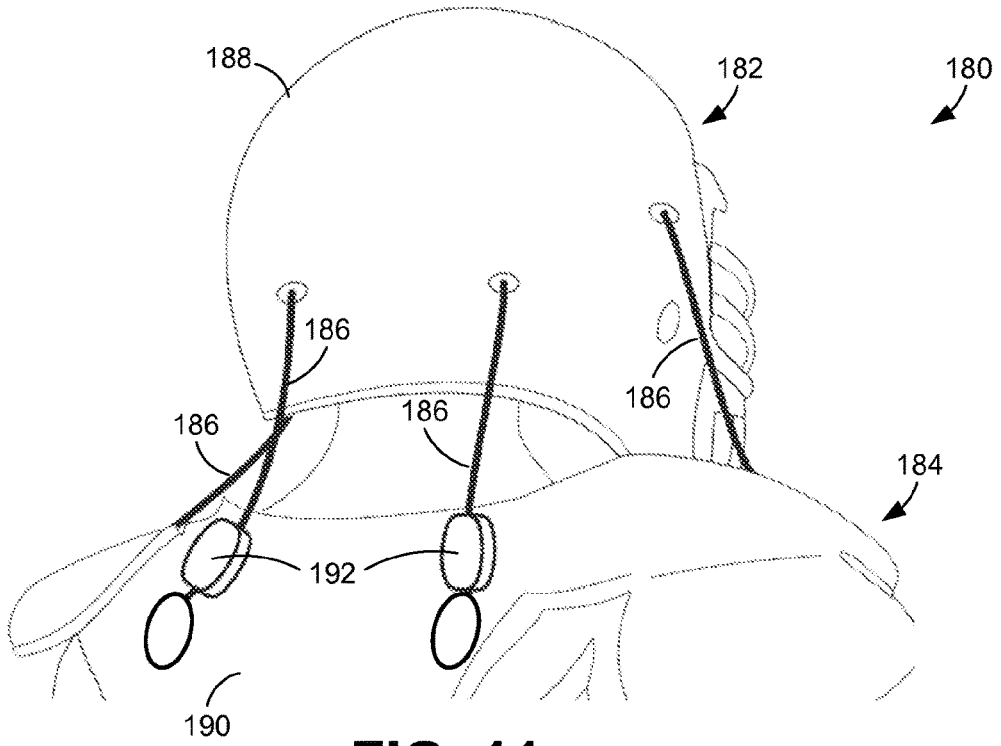
FIG. 11 is a rear perspective view of a third embodiment of a passive helmet tether system.

FIG. 11 illustrates a third embodiment of a passive helmet tether system 180 that links a protective helmet 182 to an article 184 (shoulder pads) worn by the helmet wearer. This system 180 is also similar to the system 140 shown in FIG. 9. Accordingly, the system 180 comprises multiple tethers 186 having a first or upper end attached to the outer shell 188 of the helmet 182, and a second or lower end attached to the shoulder pad outer shells 190. In this embodiment, however, an extension mechanism 192 is provided along each tether 186. Lengths of the tethers 186 are wound around an internal spool (not shown) within the extension mechanism 192, which also includes an internal torsion spring (not shown) that takes up slack. The extension mechanism 192 can further include a locking mechanism (not shown) that automatically locks the angular orientation of the internal spool, and therefore halts lengthening of the tether 186, upon a threshold angular acceleration being reached.

Figure 12:
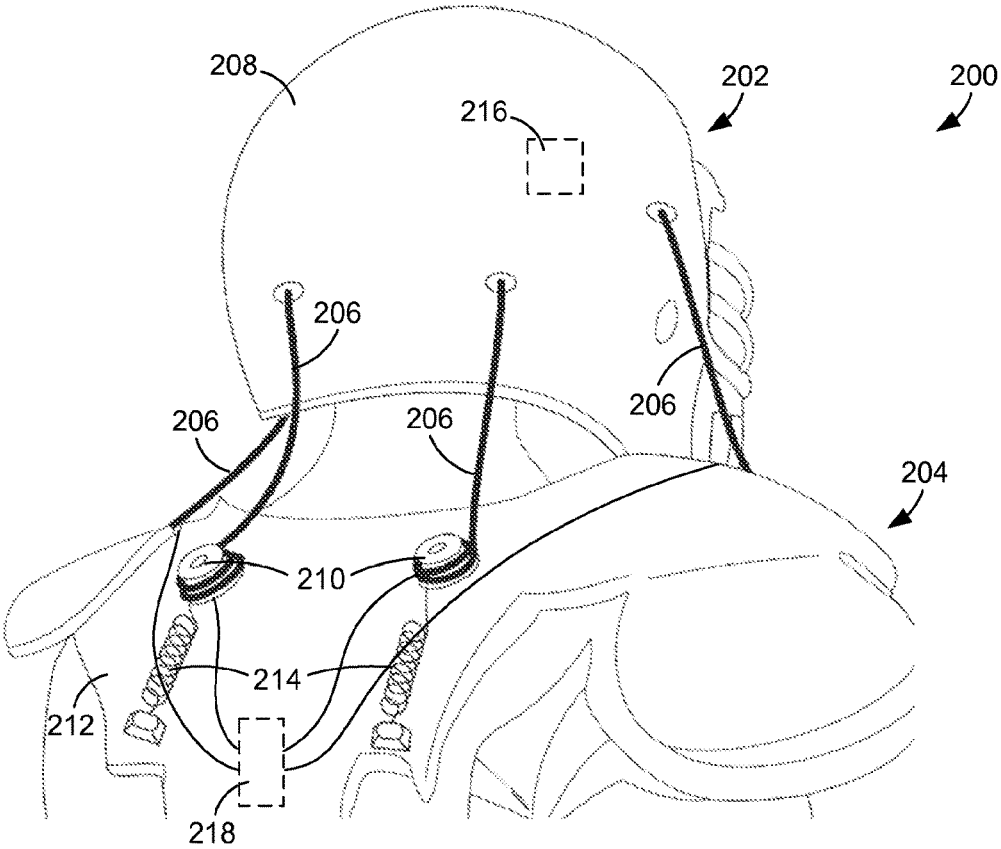
FIG. 12 is a rear perspective view of a first embodiment of an active helmet tether system.

FIG. 12 illustrates a first embodiment of an active helmet tether system 200 that links a protective helmet 202 to an article 204 (shoulder pads) worn by the helmet wearer. The system 200 includes multiple tethers 206 that extend between the helmet 202 and the shoulder pads 204. More particularly, a first or upper end of each tether is attached to the interior or exterior of the outer shell 208 of the helmet 202, and a second or lower end of each tether is attached to and wrapped around spools 210 that are releasably mounted to the shoulder pad outer shells 212. The system 200 further comprises pre-tensioned springs 214 that are attached at one end to a spool 210 and attached at the other end to the shoulder pad outer shell 212. In addition, the system 200 includes an impact sensor 216, such as an accelerometer, that is mounted to the helmet 202 or the wearer's head. The impact sensor 216 is in communication with a central controller 218 that is adapted to actuate the spools 210.

During use of the system 200, the spools 210 are free to rotate to enable lengthening of the tether 206 to enable turning of the head until an impact that exceeds a force threshold is sensed by the sensor 216. When such an impact occurs, the central controller 218 activates actuation mechanisms (not shown) associated with each spool 210 that halt further rotation of the spools and decouple the spools from the shoulder pads 204. When this occurs, the tethers 206 will no longer lengthen and the springs 214 will pull down on the spools 210 to remove slack from the tethers.

Figure 13:
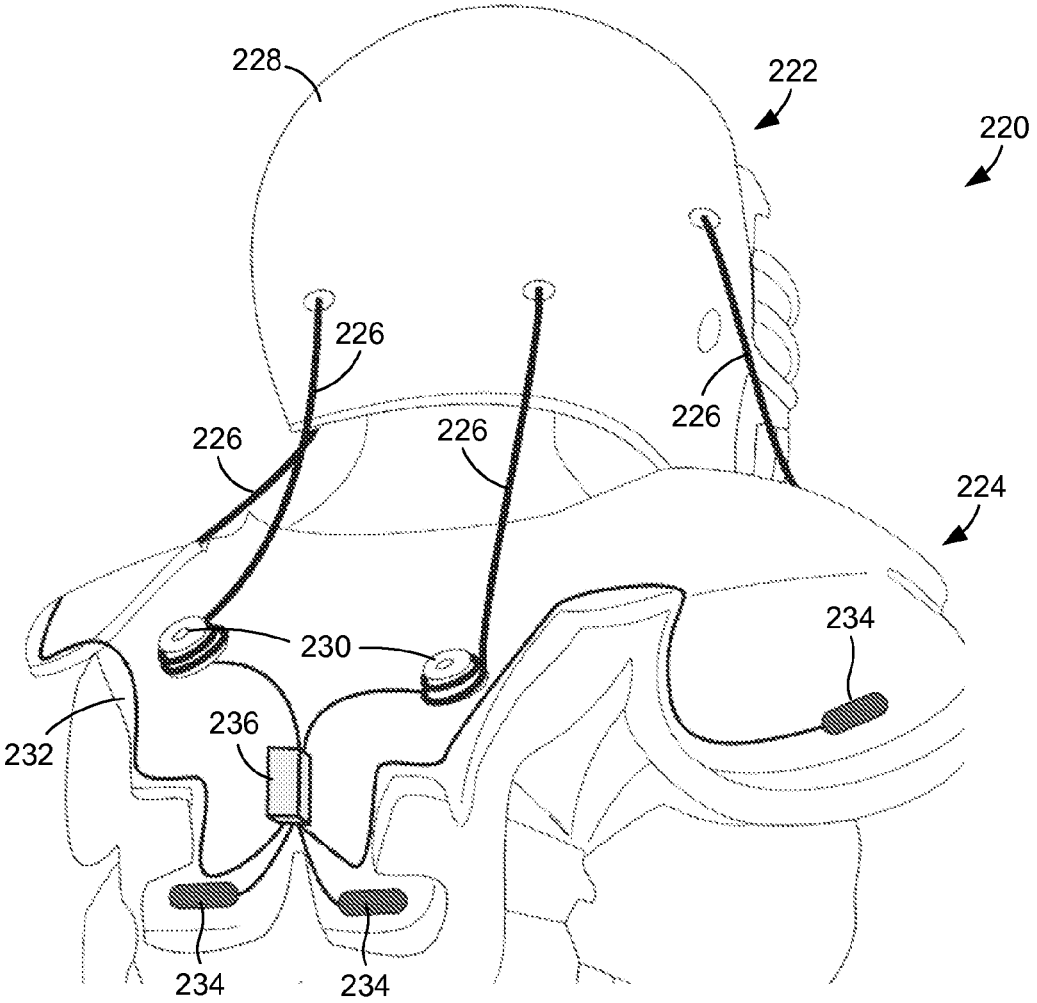
FIG. 13 is a rear perspective view of a second embodiment of an active helmet tether system.

FIG. 13 illustrates a second embodiment of an active helmet tether system 220 that links a protective helmet 222 to an article 224 (shoulder pads) worn by the helmet wearer. The system 220 includes multiple inelastic tethers 226 having a first or upper end attached to the outer shell 228 of the helmet 222, and a second or lower end attached to and wrapped around spools 230 that are fixedly mounted to the shoulder pad outer shells 232.

The system 220 further comprises multiple sensors 234, such as accelerometers, that are mounted at multiple points on the helmet wearer's body (multiple locations of the shoulder pads 224 in the example of FIG. 13). The data collected by the sensors 234 can be provided to a central controller 236 that executes a control algorithm that determines from wearer's body posture and motion that a helmet impact is likely to occur. In such a case, the central controller 236 can activate pre-tensioning mechanisms (not shown) associated with each spool 232 that wind the tethers 226 onto the spools 230 to prepare the head for an impending impact. In some embodiments, the control algorithm comprises a heuristic algorithm that adapts to the individual helmet wearer over time. In the case of a sports helmet, data from both practice and live game play can be used to refine the heuristic algorithm. In some embodiments, the pre-tensioning mechanisms can comprise electro-active materials used to form the tethers 226, such as dielectric elastomers. Signaling of such electro-active tethers could be used to induce changes in stiffness and strain.

The invention claimed is:

1. A tether system for use with a protective helmet worn by a user, the tether system comprising:

multiple tethers, each tether having a first end adapted to attach to a shell of the protective helmet and a second end adapted to attach to an article worn by the user, wherein the tethers limit movement of the helmet;

multiple rotatable spools mounted to the article, wherein the tethers are attached to and wound on the spools, wherein the spools comprise internal torsion springs that take up slack in the tethers; and a sensor that senses movement of the user, a central controller that receives data from the sensor, and actuation mechanisms associated with the spools that can be activated by the central controller, wherein the spools are releasably mounted to the article and wherein the actuation mechanisms are adapted to halt rotation of the spools and decouple the spools from the article when activated by the central controller.

2. The system of claim 1, wherein the second ends of the tethers are adapted to attach to shoulder pads worn by the user.

3. The system of claim 1, wherein the tethers are inelastic.

4. The system of claim 1, wherein the tethers are elastic.

5. The system of claim 1, wherein the spools further comprise internal locking mechanisms that automatically lock angular orientations of the spools upon a threshold angular acceleration having been reached.

6. The system of claim 1, further comprising pre-tensioned springs attached at one end to the spools and attached at another end to the article.

7. The system of claim 1, wherein the actuation mechanisms are pre-tensioning mechanisms adapted to wind the tethers on the spools when activated by the central controller.

8. The system of claim 7, wherein the system comprises multiple sensors positioned on multiple points on the user and wherein the central controller activates the pre-tensioning mechanisms when it determines from data collected by the sensors that a helmet impact is likely imminent.

9. The system of claim 8 wherein the central controller executes a heuristic algorithm that adapts to the user over time to increase an accuracy with which the helmet impact determination is made.

10. The system of claim 1, further comprising an extension mechanism provided on each tether, each extension mechanism comprising an internal spool to upon which the tether is wound.

11. The system of claim 10, wherein the extension mechanisms further comprise internal torsion springs that act on the internal spools to take up slack in the tethers.

12. The system of claim 11, wherein the extension mechanisms further comprise internal locking mechanisms that automatically lock angular orientations of the internal spools upon a threshold angular acceleration having been reached.

13. An energy absorbing system comprising:

a protective helmet adapted to be worn on the head of a user, the helmet including an outer shell;

an article adapted to be worn on the body of the user; and a tether system comprising:

multiple tethers, each tether having a first end adapted to attach to the shell of the helmet and a second end adapted to attach to the article, wherein the tethers limit movement of the helmet;

rotatable spools to which the tethers are attached and on which the tethers are wound, wherein the spools comprise internal torsion springs that take up slack in the tethers; and a sensor that senses movement of the user, a central controller that receives data from the sensor, and actuation mechanisms associated with the spools that can be activated by the central controller, wherein the spools are releasably mounted to the article and wherein the actuation mechanisms are adapted to halt rotation of the spools and decouple the spools from the article when activated by the central controller.

14. The system of claim 13, wherein the spools further comprise internal locking mechanisms that automatically lock angular orientations of the spools upon a threshold angular acceleration having been reached.

15. The system of claim 13, wherein the actuation mechanisms are pre-tensioning mechanisms adapted to wind the tethers on the spools when activated by the central controller.

* * * * *